US011866930B2

(12) United States Patent
Okumura et al.

(10) Patent No.: US 11,866,930 B2
(45) **Date of Patent: *Jan. 9, 2024**

(54) PARTITION WALL SOUND-INSULATION STRUCTURE AND SOUND-INSULATION MEMBER FOR PARTITION WALL

(71) Applicant: SEKISUI HOUSE, LTD., Osaka (JP)

(72) Inventors: Miki Okumura, Osaka (JP); Hideo Nagamatsu, Osaka (JP)

(73) Assignee: SEKISUI HOUSE, LTD., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/792,797

(22) PCT Filed: Jan. 26, 2021

(86) PCT No.: PCT/JP2021/002551

§ 371 (c)(1),
(2) Date: Jul. 14, 2022

(87) PCT Pub. No.: WO2021/153536

PCT Pub. Date: Aug. 5, 2021

(65) Prior Publication Data

US 2023/0042728 A1 Feb. 9, 2023

(30) Foreign Application Priority Data

Jan. 29, 2020 (JP) ..... 2020-012616

(51) Int. Cl.
*E04B 1/86* (2006.01)
*E04B 2/58* (2006.01)
*E04B 1/74* (2006.01)

(52) U.S. Cl.
CPC ..... *E04B 1/86* (2013.01); *E04B 2/58* (2013.01); *E04B 2001/742* (2013.01)

(58) Field of Classification Search
CPC ..... E04B 2/7409; E04B 2/7457; E04B 2/76; E04B 2/7415; E04B 2001/8263; E04B 2/56; E04B 2/58; E04B 1/86; E04B 2001/742
See application file for complete search history.

(56) References Cited

U.S. PATENT DOCUMENTS 2,268,485 A * 12/1941 Hurlbert, Jr. ..... E04B 2/58 52/290
3,309,825 A * 3/1967 Zinn ..... E04B 2/7457 52/349

(Continued)

FOREIGN PATENT DOCUMENTS

DE 20221261 U1 * 10/2005 ..... E04B 2/7411
DE 202009009095 U1 * 10/2009 ..... E04B 1/14

(Continued)

OTHER PUBLICATIONS

Notice of Submission of Publications issued in corresponding Japanese Patent Application No. 2020-012616 dated Feb. 28, 2023, with English translation.

(Continued)

*Primary Examiner* — Theodore V Adamos
(74) *Attorney, Agent, or Firm* — Birch, Stewart, Kolasch & Birch, LLP

(57) ABSTRACT

A partition wall sound insulation structure includes: a floor material on which a floor surface is formed; a ceiling material on which a ceiling surface is formed, the ceiling surface being opposed to the floor surface in a vertical direction with a space in a building interposed therebetween; a partition wall that partitions the space in a horizontal direction and includes a pair of face materials that extends in the vertical direction and is disposed with a hollow portion interposed therebetween in the horizontal direction, and a stud that is disposed in the hollow portion and supports (Continued)

the pair of face materials; a positioning member for positioning the stud in the horizontal direction; and a sound insulation face material disposed on at least one of the floor surface and the ceiling surface in the hollow portion.

11 Claims, 10 Drawing Sheets

(56) References Cited

U.S. PATENT DOCUMENTS

| | | | | | |
|---|---|---|---|---|---|
| 3,324,615 | A * | 6/1967 | Zinn | E04B 2/7409 52/364 |
| 2015/0275510 | A1* | 10/2015 | Klein | E04B 2/7411 52/232 |
| 2015/0361659 | A1* | 12/2015 | Sessler | E04B 2/16 52/483.1 |
| 2016/0369500 | A1* | 12/2016 | Leye | E04B 2/7407 |

FOREIGN PATENT DOCUMENTS

| | | | | |
|---|---|---|---|---|
| DE | 102008051696 | A1 * | 4/2010 | E04B 2/7457 |
| DE | 102017118004 | A1 * | 2/2019 | |
| EP | 2703575 | A1 * | 3/2014 | E04B 2/7457 |
| JP | 63-37710 | U | 3/1988 | |
| JP | 5-47123 | U | 6/1993 | |
| JP | 11-181928 | A | 7/1999 | |
| JP | 2002-138597 | A | 5/2002 | |
| JP | 2002-194832 | A | 7/2002 | |
| JP | 2004-278294 | A | 10/2004 | |
| JP | 2007-107315 | A | 4/2007 | |
| JP | 3222355 | U | 7/2019 | |
| KR | 200373829 | Y1 * | 1/2005 | |
| KR | 20060045215 | A * | 5/2006 | |
| KR | 20060067067 | A * | 6/2006 | E04B 1/86 |
| KR | 20060106599 | A * | 10/2006 | |
| KR | 20-0432623 | Y1 | 12/2006 | |
| KR | 20160063631 | A * | 6/2016 | |
| WO | WO-2018219491 | A1 * | 12/2018 | E04B 2/7411 |
| WO | WO-2019043405 | A1 * | 3/2019 | E04B 1/14 |
| WO | WO-2019172040 | A1 * | 9/2019 | E04B 1/86 |
| WO | WO-2020256016 | A1 * | 12/2020 | |
| WO | WO-2022043224 | A1 * | 3/2022 | E04B 2/7411 |

OTHER PUBLICATIONS

International Search Report for PCT/JP2021/002551 dated Apr. 20, 2021.

Japanese Office Action for corrseponding Japanese Application No. 2020-012616, dated Jul. 25, 2023, with English translation.

* cited by examiner

PARTITION WALL SOUND-INSULATION STRUCTURE AND SOUND-INSULATION MEMBER FOR PARTITION WALL

TECHNICAL FIELD

The present invention relates to a partition wall sound insulation structure and a sound insulation member for a partition wall for use in the partition wall sound insulation structure.

BACKGROUND ART

Conventionally, as described in Patent Literature 1, various studies have been made on sound insulation measures for preventing sound leakage from one space to the other space among adjacent spaces partitioned from each other by partition walls in a building. Patent Literature 1 recites a sound insulation partition wall in which hollow studs are arranged in a zigzag manner in a cross section of a wall, and fireproof boards of different types are attached to each hollow stud in an overlapping manner. According to this partition wall, it is considered that resonance transmission can be suppressed and a decrease in a sound insulation value can be prevented by using different types of fireproof boards in an overlapping manner.

Here, as a face material of the partition wall, a face material having a height dimension smaller than a distance from a floor surface to a ceiling surface may be used in consideration of workability during construction. Then, the partition wall is constructed by abutting an upper end surface of the face material against the ceiling surface using a board raising machine or the like. Therefore, after the construction of the partition wall, a gap corresponding to a shortage of the height dimension of the face material with respect to the distance from the floor surface to the ceiling surface is generated between a lower end surface of the face material and the floor surface. This gap causes sound leakage between chambers to invite a problem that sound insulation performance is deteriorated.

CITATION LIST

Patent Literature

Patent Literature 1: Japanese Unexamined Utility Model Publication No. SHO 63-37710

SUMMARY OF INVENTION

An object of the present invention is to provide a partition wall sound insulation structure enabling further improvement of sound insulation performance, and a sound insulation member for a partition wall for use in the partition wall sound insulation structure.

A partition wall sound insulation structure according to one aspect of the present invention includes: a floor material on which a floor surface is formed; a ceiling material on which a ceiling surface is formed, the ceiling surface being opposed to the floor surface in a vertical direction with a space in a building interposed therebetween; a partition wall that partitions the space in a horizontal direction and includes a pair of face materials that extends in the vertical direction and is disposed with a hollow portion interposed therebetween in the horizontal direction, and a stud that is disposed in the hollow portion and supports the pair of face materials; a positioning member for positioning the stud in the horizontal direction; and a sound insulation face material disposed on at least one of the floor surface and the ceiling surface in the hollow portion. The pair of face materials is disposed with a gap formed in the vertical direction between the at least one surface and the pair of face materials. The sound insulation face material is thicker than the gap, is disposed so as to block the gap from a hollow portion side, and includes a portion having a surface density higher than that of the positioning member.

A sound insulation member for a partition wall according to another aspect of the present invention is a member for use in the above partition wall sound insulation structure and includes: the sound insulation face material; and the positioning member disposed on the sound insulation face material.

According to the present invention, it is possible to provide a partition wall sound insulation structure enabling further improvement of sound insulation performance, and a sound insulation member for a partition wall for use in the partition wall sound insulation structure.

DESCRIPTION OF EMBODIMENTS

In the following, partition wall sound insulation structures according to embodiments of the present invention will be described in detail with reference to the drawings.

First Embodiment

Figure 1:
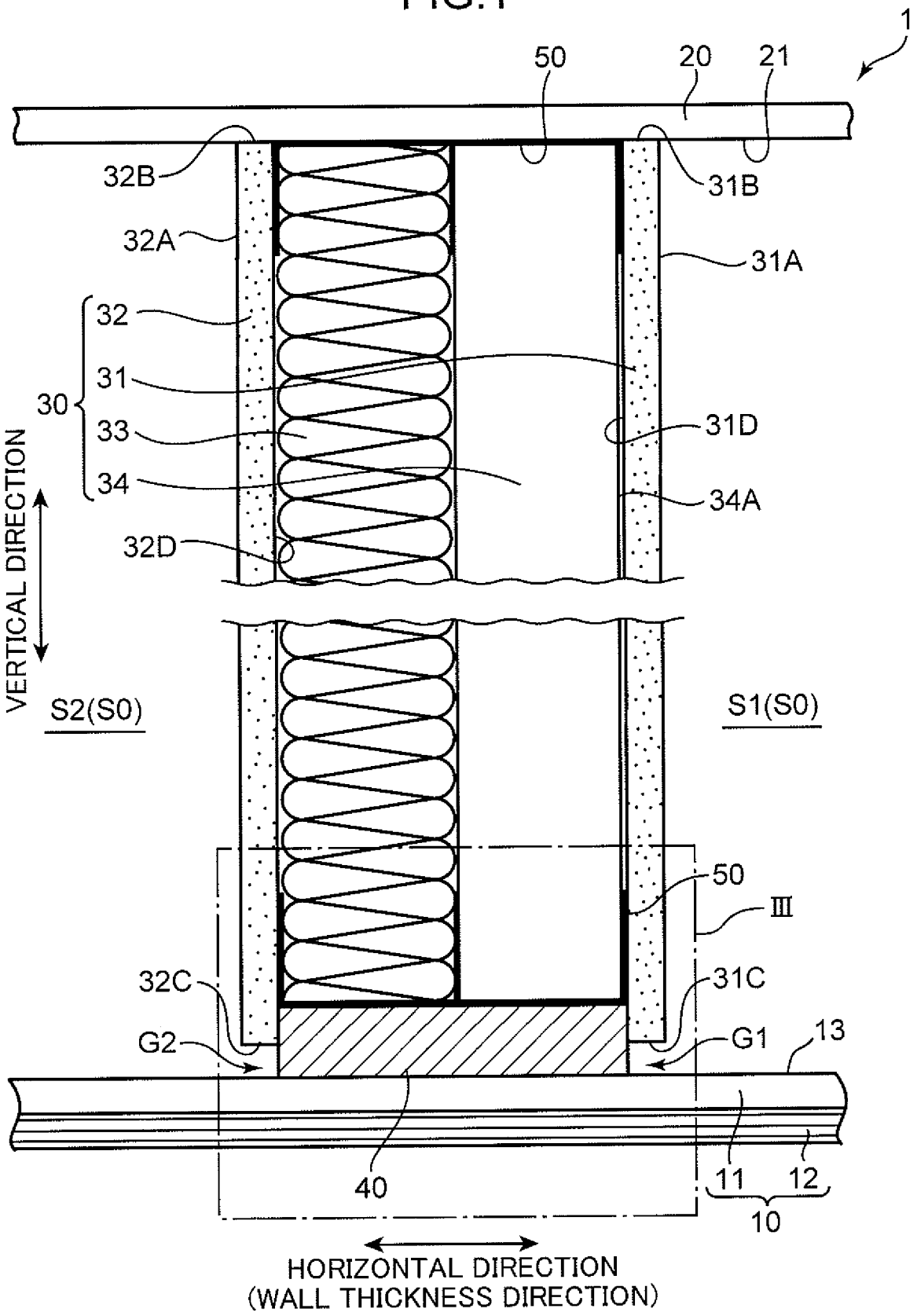
FIG. 1 is a vertical sectional view schematically illustrating a configuration of a partition wall sound insulation structure according to a first embodiment of the present invention.
Figure 2:
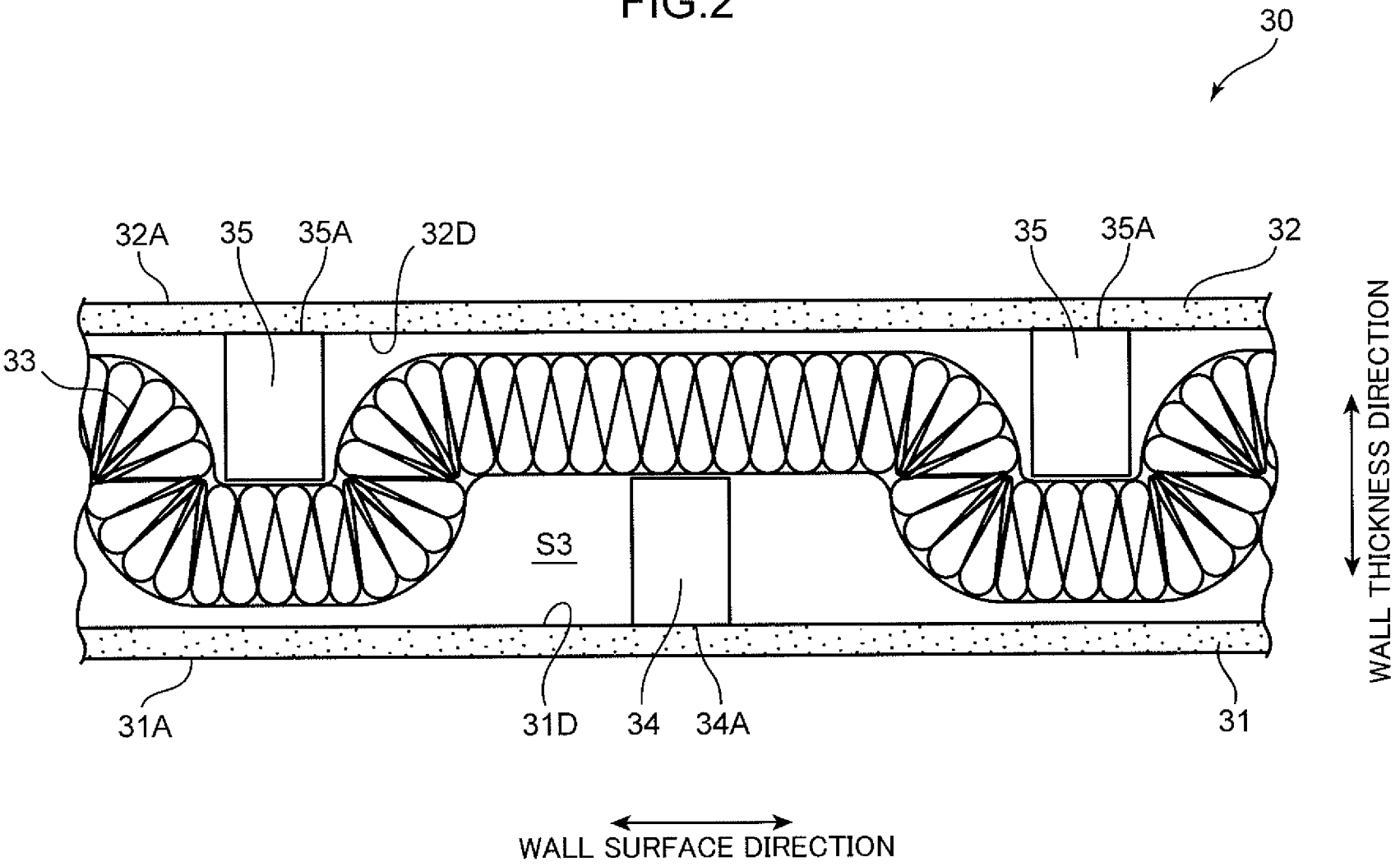
FIG. 2 is a horizontal sectional view schematically illustrating the configuration of the partition wall sound insulation structure according to the first embodiment of the present invention.
Figure 3:
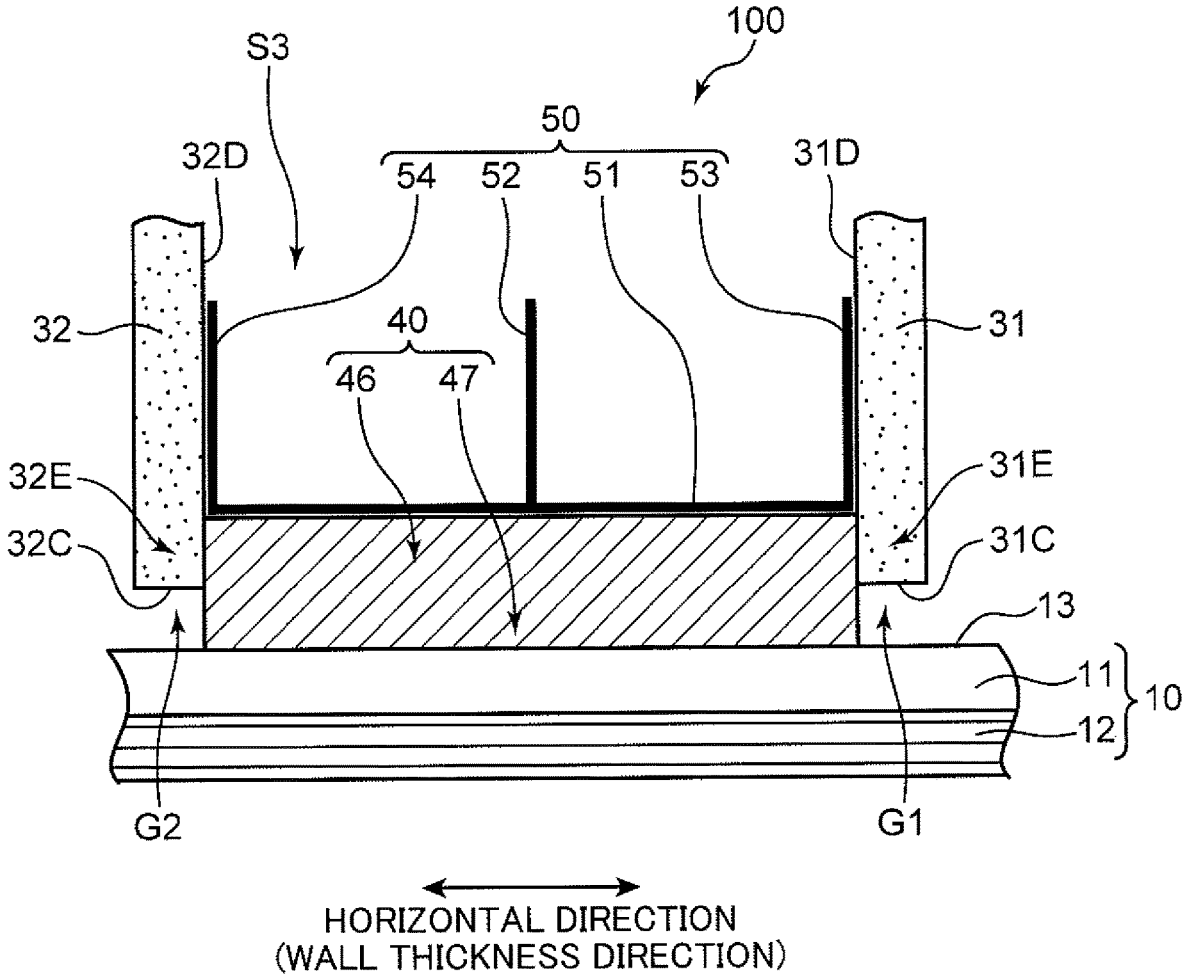
FIG. 3 is an enlarged view of a region III in FIG. 1.

First, a configuration of a partition wall sound insulation structure 1 (hereinafter, also simply referred to as the "sound insulation structure 1") according to a first embodiment of the present invention will be described with reference to FIGS. 1 to 3. FIG. 1 schematically illustrates a section of a partition wall 30 taken along a vertical direction. FIG. 2 schematically illustrates a section of the partition wall 30 taken along a horizontal direction. FIG. 3 is an enlarged view of a region III in FIG. 1.

The sound insulation structure 1 is for suppressing sound leakage from one space of two adjacent spaces (a first space S1 and a second space S2) partitioned in the horizontal direction by the partition wall 30 to the other space, for example, in a building such as a house. As illustrated in FIGS. 1 and 2, the sound insulation structure 1 mainly includes a floor material 10, a ceiling material 20, the partition wall 30, a sound insulation face material 40, and a positioning member 50. These components will be described below.

A floor surface 13 facing a space S0 (e.g., a living space in a house) side in a building is formed on the floor material 10. As illustrated in FIG. 1, the floor material 10 includes a plywood 12 laid horizontally and a flooring 11 laid on the plywood 12, and an upper surface of the flooring 11 is a floor surface 13.

The ceiling material 20 is formed with a ceiling surface 21 vertically opposed to the floor surface 13 with the space S0 interposed therebetween. The ceiling surface 21 is a surface parallel to the floor surface 13. Although the ceiling material 20 is made of for example, a gypsum plasterboard, the material is not limited thereto.

The partition wall 30 is a wall that partitions the space S0 in the horizontal direction and extends in the vertical direction. As illustrated in FIGS. 1 and 2, the partition wall 30 mainly includes a pair of face materials (a first face material 31 and a second face material 32), a first stud 34, a second stud 35, and a sound absorbing material 33.

The first face material 31 is made of, for example, the same gypsum plasterboard as the ceiling material 20, and is disposed so as to extend in the vertical direction. The first face material 31 includes a first outer surface 31A facing the first space S1 side, a first upper end surface 31B facing the ceiling surface 21 side, a first lower end surface 31C facing the floor surface 13 side, and a first inner surface 31D facing a hollow portion S3 side of the partition wall 30.

As illustrated in FIG. 1, the first face material 31 in the present embodiment is disposed such that the first upper end surface 31B abuts on the ceiling surface 21 and a gap (a first lower gap G1) is formed in the vertical direction between the first lower end surface 31C and the floor surface 13. In other words, a height dimension of the first face material 31 is smaller than a distance from the floor surface 13 to the ceiling surface 21.

The second face material 32 extends in the vertical direction and is disposed with the hollow portion S3 interposed in the horizontal direction (a wall thickness direction of the partition wall 30) with respect to the first face material 31. The second face material 32 is made of, for example, the same gypsum plasterboard as the first face material 31. The second face material 32 includes a second outer surface 32A facing the second space S2 side, a second upper end surface 32B facing the ceiling surface 21 side, a second lower end surface 32C facing the floor surface 13 side, and a second inner surface 32D facing the hollow portion S3 side and opposed to the first inner surface 31D with the hollow portion S3 interposed therebetween.

Similarly to the first face material 31, the second face material 32 in the present embodiment is disposed such that the second upper end surface 32B abuts on the ceiling surface 21 and a gap (a second lower gap G2) is formed in the vertical direction between the second lower end surface 32C and the floor surface 13. A height dimension of the second face material 32 is substantially the same as the height dimension of the first face material 31, and is smaller than the distance from the floor surface 13 to the ceiling surface 21.

The first stud 34 is a member for supporting the first face material 31, and is disposed in the hollow portion S3 (the space between the first face material 31 and the second face material 32) of the partition wall 30. The first stud 34 is a column (e.g., a wood column or a metal column) extending in the vertical direction and having a rectangular cross section, and has an outer surface 34A fixed to the first inner surface 31D. More specifically, the first face material 31 is fixed to the outer surface 34A of the first stud 34 by a fixing tool such as a screw.

The second stud 35 is a member for supporting the second face material 32, and is disposed in the hollow portion S3. Similarly to the first stud 34, the second stud 35 is a column extending in the vertical direction and having a rectangular cross section, and has an outer surface 35A fixed to the second inner surface 32D. The second face material 32 is fixed to the outer surface 35A of the second stud 35 by a fixing tool such as a screw.

As illustrated in FIG. 2, the first studs 34 and the second studs 35 in the present embodiment are arranged in a zigzag manner along a wall surface direction of the partition wall 30 (a direction orthogonal to the wall thickness direction of the partition wall 30). In other words, when viewed from the wall surface direction, the first stud 34 and the second stud 35 are disposed so as to be alternately allocated to the first inner surface 31D and the second inner surface 32D. The sound absorbing material 33 is filled in a region of the hollow portion S3 of the partition wall 30 where the first stud 34 and the second stud 35 are not disposed. Note that the sound absorbing material 33 is not an essential component in the partition wall sound insulation structure of the present invention, and may be omitted.

As illustrated in FIGS. 1 and 3, the sound insulation face material 40 is disposed on the floor surface 13 in the hollow portion S3 of the partition wall 30. The sound insulation face material 40 is a member for suppressing sound leakage between chambers through the first lower gap G1 and the second lower gap G2, and includes a portion that is thicker than the first lower gap G1 and the second lower gap G2, is disposed to block the first lower gap G1 and the second lower gap G2 from the hollow portion S3 side, and has a surface density (kg/m$^2$) higher than that of the positioning member 50. Although the sound insulation face material 40 in the present embodiment is a face material (an asphalt-based damping material) having a configuration in which iron powder solidified with asphalt is sandwiched between nonwoven fabrics, the material is not limited thereto. The sound insulation face material 40 is a member having flexibility that enables following of a curved surface even in a case where the floor surface 13 includes the curved surface.

The sound insulation face material 40 has a width from the first inner surface 31D to the second inner surface 32D, and has a predetermined length in the wall surface direction of the partition wall 30 (a direction orthogonal to a paper surface in FIG. 3). The sound insulation face material 40 is a face material elongated in the wall surface direction, and is provided over the entire wall surface direction of the partition wall 30. As illustrated in FIG. 3, the sound insulation face material 40 in the present embodiment includes a first face material portion 47 having the same thickness as the first lower gap G1 and the second lower gap G2, and a second face material portion 46 overlapping a lower end portion 31E of the first face material 31 and a lower end portion 32E of the second face material 32 in the wall thickness direction of the partition wall 30. The second face material portion 46 is a portion of the sound insulation face material 40 above the first lower end surface 31C and the second lower end surface 32C, and has both side surfaces in a width direction in contact with the first inner surface 31D and the second inner surface 32D, respectively. The first face material portion 47 is a portion of the sound insulation face material 40 below the first lower end surface 31C and the second lower end surface 32C, and has both side surfaces in a width direction blocking the first lower gap G1 and the second lower gap G2 from the hollow portion S3 side.

The second face material portion 46 has a surface density higher than the surface density of the positioning member 50. The surface density of the second face material portion 46 is preferably equal to or higher than a surface density of the first face material 31 and a surface density of the second face material 32, and more preferably equal to or higher than a surface density of the floor material 10.

Meanwhile, a surface density of the first face material portion 47 is not particularly limited, and may be lower than the surface density of the second face material portion 46 or may be the same as the surface density of the second face material portion 46. In other words, there may be a difference in surface density in the sound insulation face material 40, and the difference is provided, for example, by an iron powder concentration. In addition, the sound insulation face material 40 in the present embodiment has a coincidence frequency different from that of the floor material 10.

The positioning member 50 (runner) is a member for positioning the first stud 34 and the second stud 35 in the horizontal direction (the wall thickness direction of the partition wall 30). The positioning member 50 is made of, for example, a thin iron plate, and is placed on the sound insulation face material 40 (the second face material portion 46). The positioning member 50 and the sound insulation face material 40 constitute a sound insulation member for a partition wall 100 (FIG. 3) in the present embodiment.

As shown in FIG. 3, the positioning member 50 includes a flat plate-shaped base portion 51 placed on the second face material portion 46, a central erect portion 52 vertically rising from the base portion 51, a first end side erect portion 53, and a second end side erect portion 54. The base portion 51 is a thin plate having substantially the same width and length as the sound insulation face material 40. The central erect portion 52 is a thin plate perpendicularly rising from a central portion of the base portion 51 in a width direction, and extends in the wall surface direction of the partition wall 30 (the direction orthogonal to a paper surface in FIG. 3). The first end side erect portion 53 and the second end side erect portion 54 are thin plates rising perpendicularly from both the end portions in the width direction of the base portion 51, and extend parallel to the central erect portion 52.

A lower end portion of the first stud 34 (FIGS. 1 and 2) is inserted into a groove between the central erect portion 52 and the first end side erect portion 53, and is fixed to the first end side erect portion 53 by screwing. A lower end portion of the second stud 35 (FIG. 2) is inserted into a groove between the central erect portion 52 and the second end side erect portion 54, and is fixed to the second end side erect portion 54 by screwing or the like.

As illustrated in FIG. 1, the positioning member 50 is also fixed to the ceiling surface 21. Specifically, the positioning member 50 (the base portion 51) is fixed to a portion of the ceiling surface 21 between the first face material 31 and the second face material 32 by screwing or tape bonding. Upper end portions of the first stud 34 and the second stud 35 are inserted into grooves of the positioning member 50 fixed to the ceiling surface 21, and are fixed to the positioning member 50 by screwing or the like similarly to the lower end portions.

The positioning member 50 is not limited to a single plate material in which two grooves are formed. For example, two plate materials formed in a U-shape in a sectional view may be placed side by side on the sound insulation face material 40.

As described in the foregoing, in the sound insulation structure 1 according to the present embodiment, the sound insulation face material 40 thicker than the gap between the floor surface 13 and the face material of the partition wall 30 is disposed in the hollow portion S3 of the partition wall 30, and the gap is blocked by the sound insulation face material 40 from the hollow portion S3 side. Therefore, sound leakage between the chambers through the gap can be suppressed. Moreover, the sound insulation face material 40 includes the second face material portion 46 having the surface density higher than that of the positioning member 50. Therefore, sound insulation performance can be significantly improved as compared with a case where the positioning member 50 is directly disposed on the floor surface 13 and the gap is blocked by the first end side erect portion 53 and the second end side erect portion 54. In addition, according to the sound insulation structure 1, the gap can be blocked by dry and simple construction. Therefore, as compared with a case where the gap is filled by caulking construction, it is not necessary to cure portions other than the construction portion, variation in sound insulation performance hardly occurs, and deterioration in sound insulation performance due to aging deterioration can also be suppressed.

Second Embodiment

Next, a configuration of a partition wall sound insulation structure 2 (hereinafter, also simply referred to as the "sound insulation structure 2") according to a second embodiment of the present invention will be described with reference to FIG. 4. Although the sound insulation structure 2 according to the second embodiment basically has the same configuration as the sound insulation structure 1 according to the first embodiment and provides the same effects as those of the first embodiment, the sound insulation structure is different from the first embodiment in that a gap between an upper end surface of the partition wall 30 and the ceiling surface 21 is blocked by the sound insulation face material 40. In the following, only differences from the first embodiment will be described.

Figure 4:
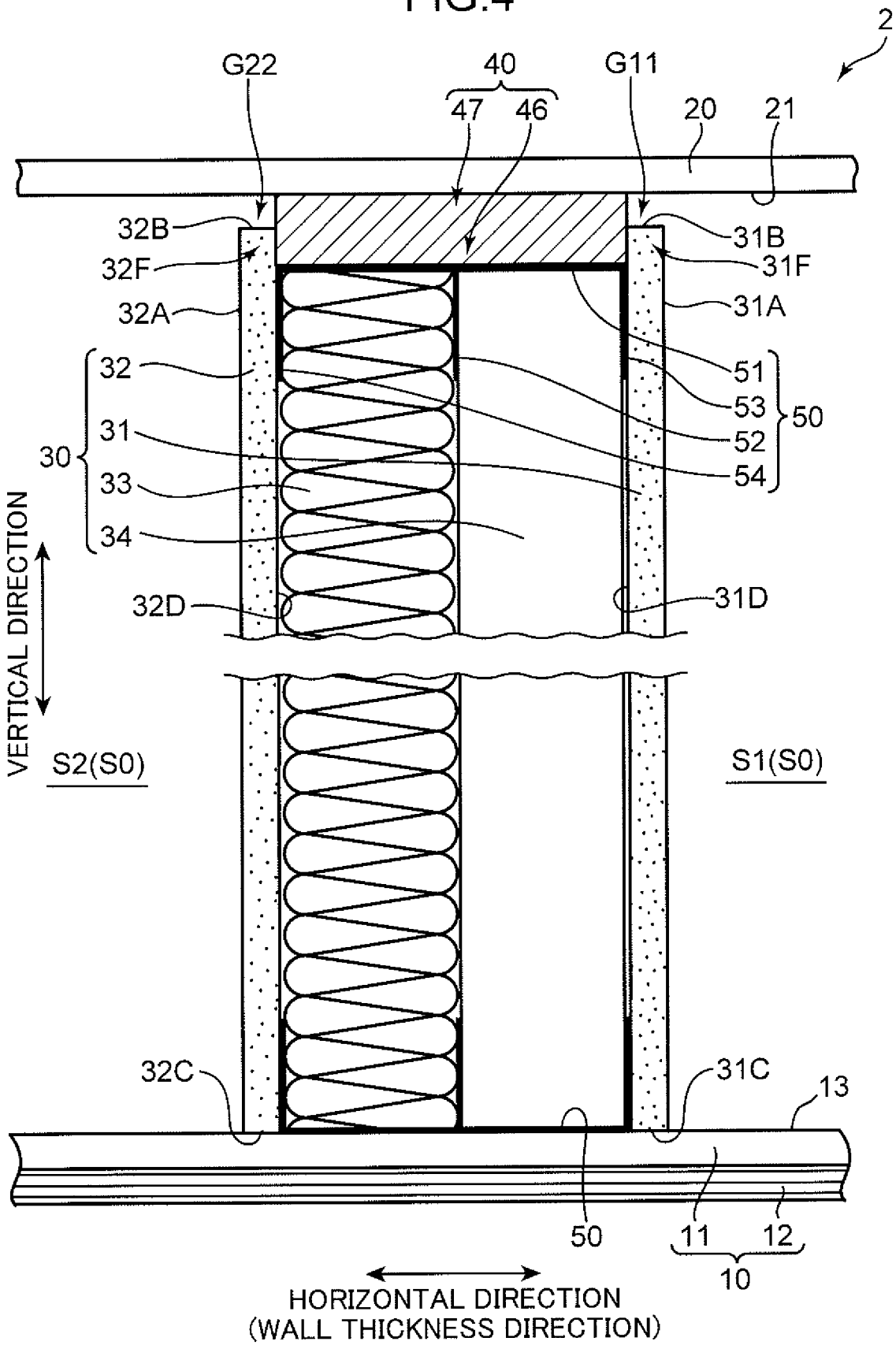
FIG. 4 is a vertical sectional view schematically illustrating a configuration of a partition wall sound insulation structure according to a second embodiment of the present invention.

FIG. 4 schematically illustrates a cross section of the partition wall 30 taken along the vertical direction in the second embodiment. As illustrated in FIG. 4, the first face material 31 according to the second embodiment is disposed such that the first lower end surface 31C abuts on the floor surface 13 and a gap (a first upper gap G11) is formed in the vertical direction between the first upper end surface 31B and the ceiling surface 21. Similarly, the second face material 32 in the second embodiment is disposed such that the second lower end surface 32C abuts on the floor surface 13 and a gap (a second upper gap G22) is formed in the vertical direction between the second upper end surface 32B and the ceiling surface 21.

The sound insulation face material 40 is disposed on the ceiling surface 21 in the hollow portion S3 of the partition wall 30. The sound insulation face material 40 is thicker than the first upper gap G11 and the second upper gap G22, is disposed so as to block the first upper gap G11 and the second upper gap G22 from the hollow portion S3 side, and includes a portion having a surface density higher than that of the positioning member 50. The sound insulation face material 40 is a member having flexibility that enables following of a curved surface even in a case where the ceiling surface 21 includes the curved surface.

Specifically, the sound insulation face material 40 in the second embodiment includes the first face material portion 47 having the same thickness as the first upper gap G11 and the second upper gap G22, and the second face material portion 46 overlapping an upper end portion 31F of the first face material 31 and an upper end portion 32F of the second face material 32 in the wall thickness direction of the partition wall 30. The second face material portion 46 is a portion of the sound insulation face material 40 below the first upper end surface 31B and the second upper end surface 32B, and has the surface density higher than that of the positioning member 50. The first face material portion 47 is a portion of the sound insulation face material 40 above the first upper end surface 31B and the second upper end surface 32B, and both the side surfaces in the width direction block the first upper gap G11 and the second upper gap G22 from the hollow portion S3 side. The sound insulation face material 40 in the second embodiment has a coincidence frequency different from that of the ceiling material 20. As illustrated in FIG. 4, the positioning member 50 is disposed on a lower surface of the sound insulation face material 40 (the second face material portion 46).

According to the sound insulation structure 2 of the second embodiment, by disposing the sound insulation face material 40 that blocks the gap between the face material of the partition wall 30 and the ceiling surface 21, it is possible to effectively suppress sound leakage between chambers same as in the case of the first embodiment. Note that the sound insulation face material 40 is not exclusively disposed on only one of the floor surface 13 and the ceiling surface 21, but may be disposed on both the floor surface 13 and the ceiling surface 21.

Third Embodiment

Next, a partition wall sound insulation structure 3 (hereinafter, also simply referred to as the "sound insulation structure 3") according to a third embodiment of the present invention will be described with reference to FIG. 5. Although the sound insulation structure 3 according to the third embodiment basically has the same configuration as the sound insulation structures 1 and 2 according to the first and second embodiments and exhibits the same effects, the sound insulation structure is different in further including a first wall-side sound insulation face material 61 and a second wall-side sound insulation face material 62 disposed in the hollow portion S3 of the partition wall 30. In the following, only differences from the first embodiment will be described.

Figure 5:
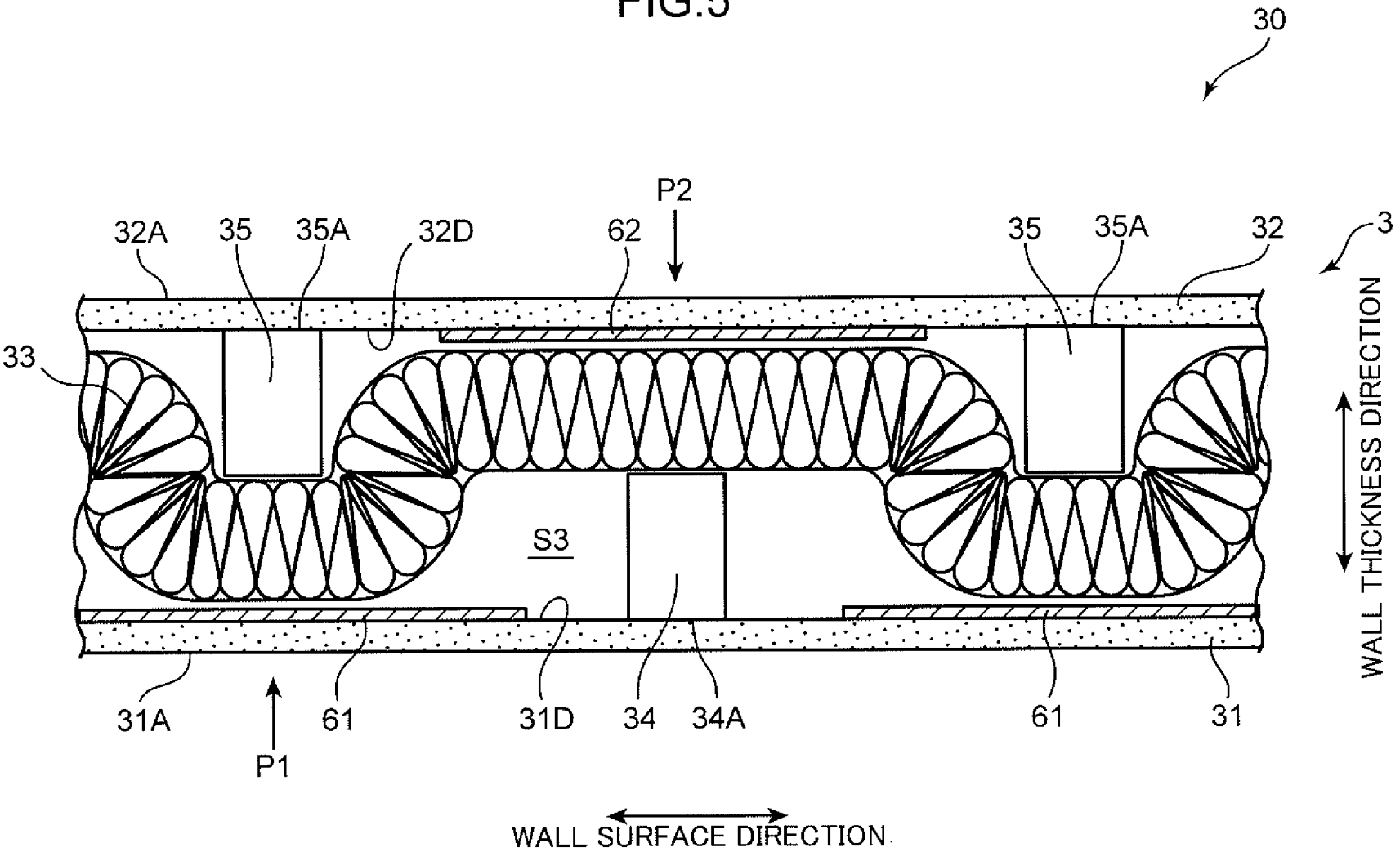
FIG. 5 is a horizontal sectional view schematically illustrating a configuration of a partition wall sound insulation structure according to a third embodiment of the present invention.

FIG. 5 is a horizontal sectional view of the partition wall 30 according to the third embodiment. As illustrated in FIG. 5, a plurality of the first wall-side sound insulation face materials 61 are stuck to a part of the first inner surface 31D so as to overlap the second studs 35 in a front view (an arrow P1 in FIG. 5) of the first face material 31 and to be spaced apart from the first studs 34 in the wall surface direction. More specifically, the first wall-side sound insulation face material 61 extends in the vertical direction, and is stuck to the first inner surface 31D in a state of having a gap formed in the wall surface direction from the first stud 34 and a gap formed in the wall thickness direction from the second stud 35. As illustrated in FIG. 5, the sound absorbing material 33 is laid in the gap between the first wall-side sound insulation face material 61 and the second stud 35. The first wall-side sound insulation face material 61 is stuck to the first inner surface 31D by, for example, an adhesive or the like, and the adhesive may be applied to the entire bonding surface, or the adhesive may be applied to a part of the bonding surface.

Although not illustrated in FIG. 5, the first wall-side sound insulation face material 61 is located between two first studs 34 adjacent to each other in the wall surface direction. Although the center of the first wall-side sound insulation face material 61 in the wall surface direction coincides with the center of the second stud 35 in the wall surface direction, the present invention is not limited thereto.

The first wall-side sound insulation face material 61 has a coincidence frequency different from that of the first face material 31. Specifically, the first wall-side sound insulation face material 61 is made of a gypsum plasterboard containing a glass fiber nonwoven fabric and having a constant thickness, and has the coincidence frequency different from that of the first face material 31 by 1/12 octave. Although the first wall-side sound insulation face material 61 in the present embodiment is made of a gypsum plasterboard thinner than the first face material 31, the material is not limited thereto.

A plurality of the second wall-side sound insulation face materials 62 are stuck to a part of the second inner surface 32D so as to overlap the first studs 34 in a front view (an arrow P2 in FIG. 5) of the second face material 32 and to be spaced apart from the second studs 35 in the wall surface direction. Specifically, the second wall-side sound insulation face material 62 extends in the vertical direction, and is stuck to the second inner surface 32D in a state of having a gap formed in the wall surface direction from the second stud 35 and a gap formed in the wall thickness direction from the first stud 34. The sound absorbing material 33 is laid in the gap between the second wall-side sound insulation face material 62 and the first stud 34. The second wall-side sound insulation face material 62 is stuck to the second inner surface 32D by, for example, an adhesive or the like, and the adhesive may be applied to the entire bonding surface, or the adhesive may be applied to a part of the bonding surface.

As illustrated in FIG. 5, the second wall-side sound insulation face material 62 is located between two second studs 35 adjacent to each other in the wall surface direction. Although the center of the second wall-side sound insulation face material 62 in the wall surface direction coincides with the center of the first stud 34 in the wall surface direction, the present invention is not limited thereto.

The first wall-side sound insulation face materials 61 and the second wall-side sound insulation face materials 62 in the present embodiment are arranged in a zigzag manner along the wall surface direction of the partition wall 30. In other words, the positions of the first wall-side sound insulation face material 61 and the second wall-side sound insulation face material 62 disposed in order as viewed from the wall surface direction are alternately allocated to the first inner surface 31D and the second inner surface 32D.

The second wall-side sound insulation face material 62 has a coincidence frequency different from that of the second face material 32. Specifically, the second wall-side sound insulation face material 62 is made of a gypsum plasterboard containing a glass fiber nonwoven fabric and having a constant thickness, and has the coincidence frequency different from that of the second face material 32 by 1/12 octave similarly to the first wall-side sound insulation face material 61. Although the second wall-side sound insulation face material 62 is made of a gypsum plasterboard thinner than the second face material 32, the material is not limited thereto.

According to the sound insulation structure 3 according to the third embodiment, by additionally disposing the face material having the coincidence frequency different from that of the face material of the partition wall 30, sound leakage to an adjacent space via the partition wall 30 can be more effectively suppressed. Moreover, since the additional face material is provided on the hollow portion S3 side of the partition wall 30, it is also possible to suppress an increase in the thickness of the partition wall 30. Note that the present invention is not limited to the case where both the first wall-side sound insulation face material 61 and the second wall-side sound insulation face material 62 are provided, and only one of these sound insulation face materials may be provided.

Fourth Embodiment

Next, a partition wall sound insulation structure 4 (hereinafter, also simply referred to as the "sound insulation structure 4") according to a fourth embodiment of the present invention will be described with reference to FIG. 6. Although the sound insulation structure 4 according to the fourth embodiment basically has the same configuration as the sound insulation structures 1 to 3 according to the first to third embodiments and exhibits the same effects, the sound insulation structure is different in further including a first ceiling-side sound insulation face material 71 and a second ceiling-side sound insulation face material 72. In the following, only differences from the first to third embodiments will be described.

Figure 6:
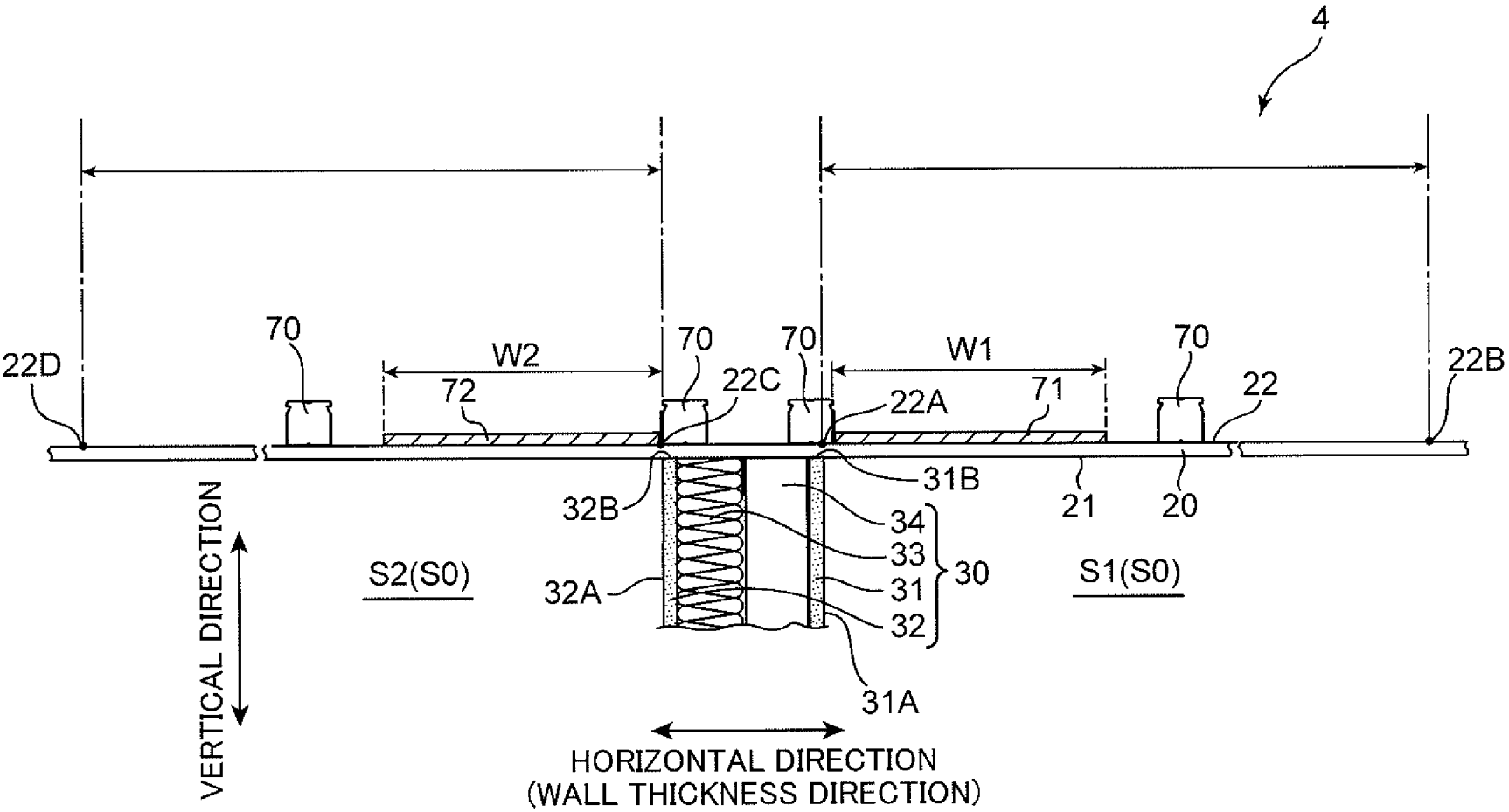
FIG. 6 is a vertical sectional view schematically illustrating a configuration of a partition wall sound insulation structure according to a fourth embodiment of the present invention.

FIG. 6 is a vertical sectional view of the partition wall 30 according to the fourth embodiment. As illustrated in FIG. 6, the ceiling material 20 has a ceiling upper surface 22 facing the side (the side of a space above ceiling) opposite to the ceiling surface 21, and a plurality of cradlings 70 are disposed on the ceiling upper surface 22. In the present embodiment, each of the cradlings 70 is disposed so as to have a length direction facing the wall surface direction of the partition wall 30 (a direction orthogonal to a paper surface in FIG. 6).

The plurality of cradlings 70 are disposed at intervals (at equal intervals) in the horizontal direction (the direction orthogonal to the length direction of the cradling 70) on the ceiling upper surface 22. As illustrated in FIG. 6, the cradlings 70 are disposed in portions of the ceiling upper surface 22 located above the first face material 31 and the second face material 32. In other words, the cradlings 70 are disposed at positions of the ceiling upper surface 22 overlapping the first face material 31 and the second face material 32 in the vertical direction.

The first ceiling-side sound insulation face material 71 is stuck to at least a portion of the ceiling material 20 between a position 22A corresponding to the first outer surface 31A and a position 22B corresponding to the center of the first space S1 in the horizontal direction (the wall thickness direction of the partition wall 30). More specifically, as illustrated in FIG. 6, the first ceiling-side sound insulation face material 71 is stuck to the ceiling upper surface 22 in a space between one cradling 70 overlapping the first face material 31 in the vertical direction and another cradling 70 adjacent, on the first space S1 side, to the one cradling 70. The "position corresponding to the first outer surface 31A" represents a position of the ceiling material 20 overlapping the first outer surface 31A in the vertical direction.

As illustrated in FIG. 6, the first ceiling-side sound insulation face material 71 in the present embodiment is stuck to the ceiling upper surface 22 in a part of the space between the one cradling 70 and the other cradling 70. In other words, a width W1 of the first ceiling-side sound insulation face material 71 is smaller than a distance between the one cradling 70 and the other cradling 70.

In the first ceiling-side sound insulation face material 71, an end portion on the partition wall 30 side is in contact with a side surface of the one cradling 70 (the side surface opposed to the other cradling 70). In other words, the center of the first ceiling-side sound insulation face material 71 in the width direction is located closer to the partition wall 30 (the first outer surface 31A) side than to the center between the one cradling 70 and the other cradling 70.

The first ceiling-side sound insulation face material 71 has a coincidence frequency different from that of the ceiling material 20. Specifically, the first ceiling-side sound insulation face material 71 is made of a gypsum plasterboard containing a glass fiber nonwoven fabric, and has the coincidence frequency different from that of the ceiling material 20 by 1/12 octave.

The second ceiling-side sound insulation face material 72 is stuck to at least a portion of the ceiling material 20 between a position 22C corresponding to the second outer surface 32A and a position 22D corresponding to the center of the second space S2 in the horizontal direction (the wall thickness direction of the partition wall 30). Specifically, as illustrated in FIG. 6, the second ceiling-side sound insulation face material 72 is stuck to the ceiling upper surface 22 in a space between one cradling 70 overlapping the second face material 32 in the vertical direction and another cradling 70 adjacent, on the second space S2 side, to the one cradling 70. The "position corresponding to the second outer surface 32A" represents a position of the ceiling material 20 overlapping the second outer surface 32A in the vertical direction.

The second ceiling-side sound insulation face material 72 is stuck to the ceiling upper surface 22 in a part of the space between the one cradling 70 and the other cradling 70. In other words, a width W2 of the second ceiling-side sound insulation face material 72 is smaller than the distance between the cradlings. In the second ceiling-side sound insulation face material 72, an end portion on the partition wall 30 side is in contact with the side surface of the one cradling 70 (the side surface opposed to the other cradling 70). In other words, the center of the second ceiling-side sound insulation face material 72 in the width direction is located closer to the partition wall 30 (the second outer surface 32A) side than to the center between the one cradling 70 and the other cradling 70.

The second ceiling-side sound insulation face material 72 has a coincidence frequency different from that of the ceiling material 20. Specifically, the second ceiling-side sound insulation face material 72 is made of a gypsum plasterboard containing a glass fiber nonwoven fabric, and has the coincidence frequency different from that of the ceiling material 20 by 1/12 octave similarly to the first ceiling-side sound insulation face material 71.

As described in the foregoing, in the sound insulation structure 4 according to the fourth embodiment, the face material having the coincidence frequency different from that of the ceiling material 20 is stuck to the portion of the ceiling material 20 between the position corresponding to the outer surface of the partition wall 30 and the position corresponding to the horizontal center of the space. Therefore, when sound generated in one of the first space S1 and the second space S2 partitioned by the partition wall 30 is about to propagate to the other space via the ceiling material 20 due to the coincidence effect, the coincidence effect of the ceiling material 20 can be suppressed. Accordingly, sound leakage via the ceiling material 20 is suppressed to improve sound insulation performance. Note that the present invention is not limited to the case where both the first ceiling-side sound insulation face material 71 and the second ceiling-side sound insulation face material 72 are provided, and only one of these may be provided.

Fifth Embodiment

Next, a partition wall sound insulation structure 5 (hereinafter, also simply referred to as the "sound insulation structure 5") according to a fifth embodiment of the present invention will be described with reference to FIGS. 7 to 9. Although the sound insulation structure 5 according to the fifth embodiment basically has the same configuration as the sound insulation structures 1 to 4 according to the first to fourth embodiments and exhibits the same effects, the sound insulation structure is different in further including a first outer wall side sound insulation face material 83 and a second outer wall side sound insulation face material 84. In the following, only differences from the first to fourth embodiments will be described.

Figure 7:
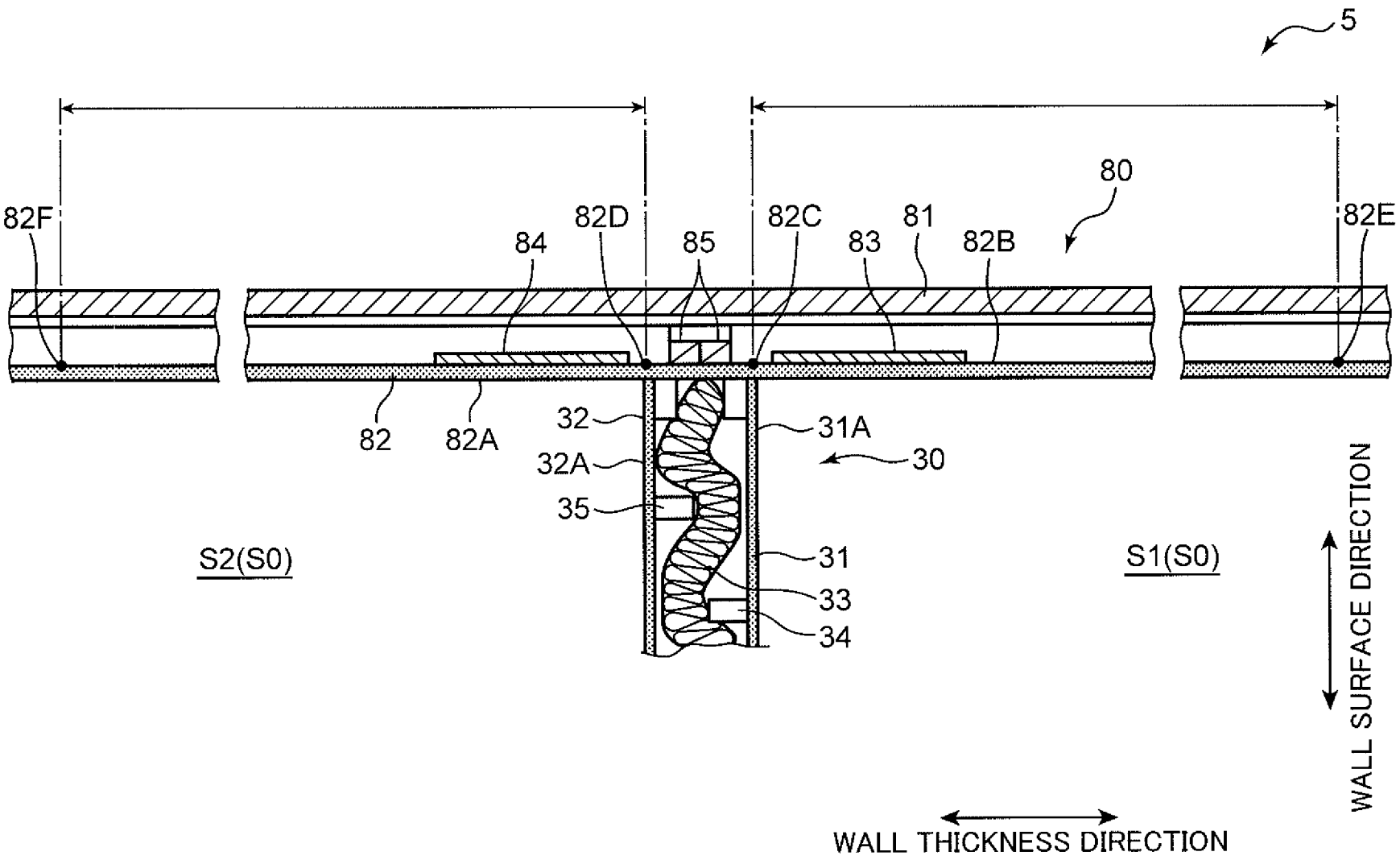
FIG. 7 is a horizontal sectional view schematically illustrating a configuration of a partition wall sound insulation structure according to a fifth embodiment of the present invention.

FIG. 7 is a horizontal sectional view of an abutment portion (joint portion) between the partition wall 30 and an outer wall 80. The sound insulation structure 5 includes the outer wall 80 extending in a direction intersecting (orthogonal to) the partition wall 30. As illustrated in FIG. 7, one end portion of the partition wall 30 in the wall surface direction abuts on an inner surface of the outer wall 80.

The outer wall 80 includes an outer wall panel 81, an outer wall face material 82 disposed with a hollow portion interposed between the outer wall panel 81 and the outer wall face material, and a vertical bar 85 extending in the vertical direction in the hollow portion. The outer wall face material 82 is made of, for example, a gypsum plasterboard, and includes an inner surface 82A facing the space S0 side in the building and a back surface 82B facing the side (hollow portion side) opposite to the inner surface 82A. The sound insulation structure 5 includes the first outer wall side sound insulation face material 83 and the second outer wall side sound insulation face material 84 stuck to the back surface 82B of the outer wall face material 82.

The first outer wall side sound insulation face material 83 is stuck to at least a portion of the back surface 82B of the outer wall face material 82 between a position 82C corresponding to the first outer surface 31A and a position 82E corresponding to the center of the first space S1 in the horizontal direction. Here, the "position corresponding to the first outer surface 31A" represents a position through which an extension line of the first outer surface 31A passes on the back surface 82B of the outer wall face material 82. The first outer wall side sound insulation face material 83 is made of a gypsum plasterboard having a coincidence frequency different from that of the outer wall face material 82, specifically, the coincidence frequency different from that of the outer wall face material 82 by 1/12 octave.

The second outer wall side sound insulation face material 84 is stuck to at least a portion of the back surface 82B of the outer wall face material 82 between a position 82D corresponding to the second outer surface 32A and a position 82F corresponding to the center of the second space S2 in the horizontal direction. Here, the "position corresponding to the second outer surface 32A" represents a position through which an extension line of the second outer surface 32A passes on the back surface 82B of the outer wall face material 82. The second outer wall side sound insulation face material 84 has a coincidence frequency different from that of the outer wall face material 82, specifically, the coincidence frequency different from that of the outer wall face material 82 by 1/12 octave.

Figure 8:
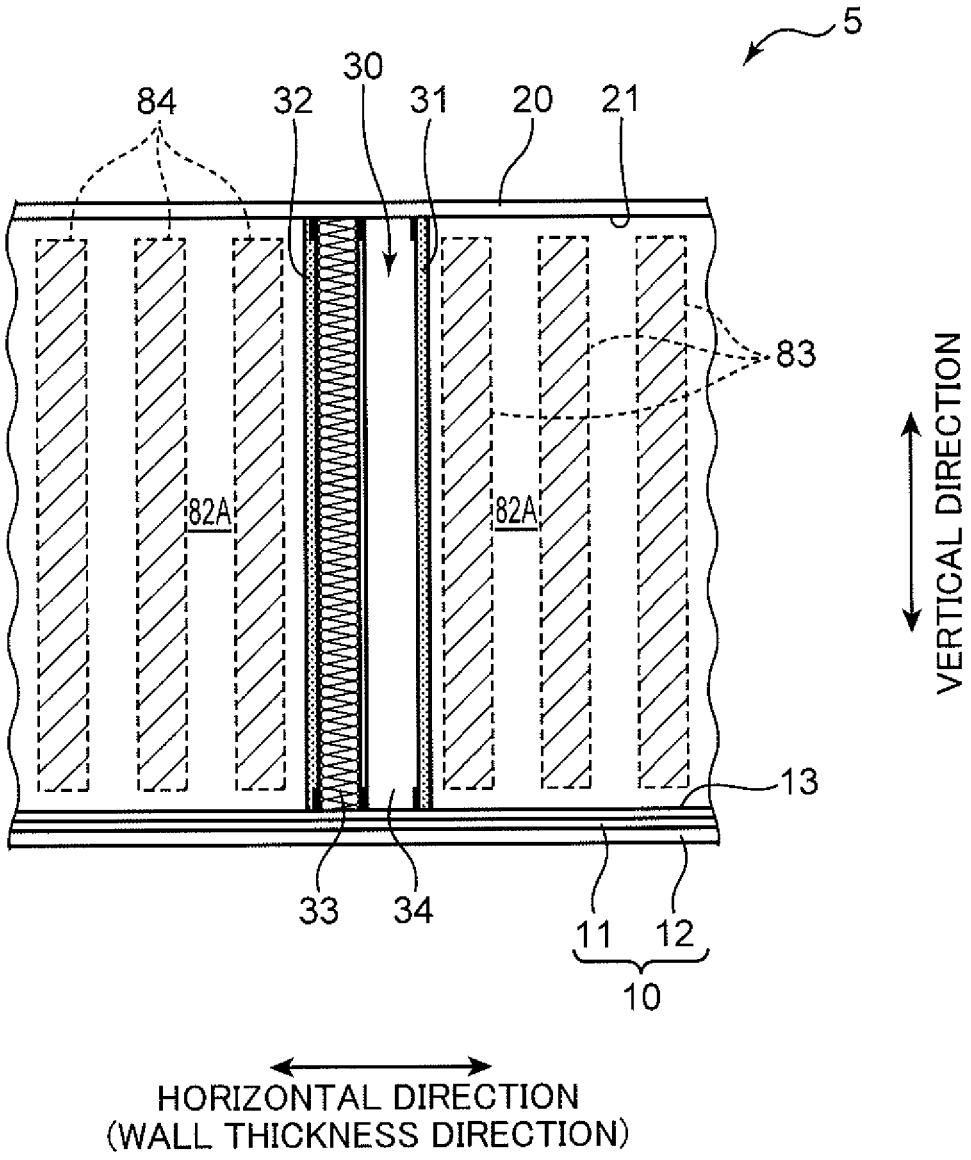
FIG. 8 is a vertical sectional view schematically illustrating the configuration of the partition wall sound insulation structure according to the fifth embodiment of the present invention.
Figure 9:
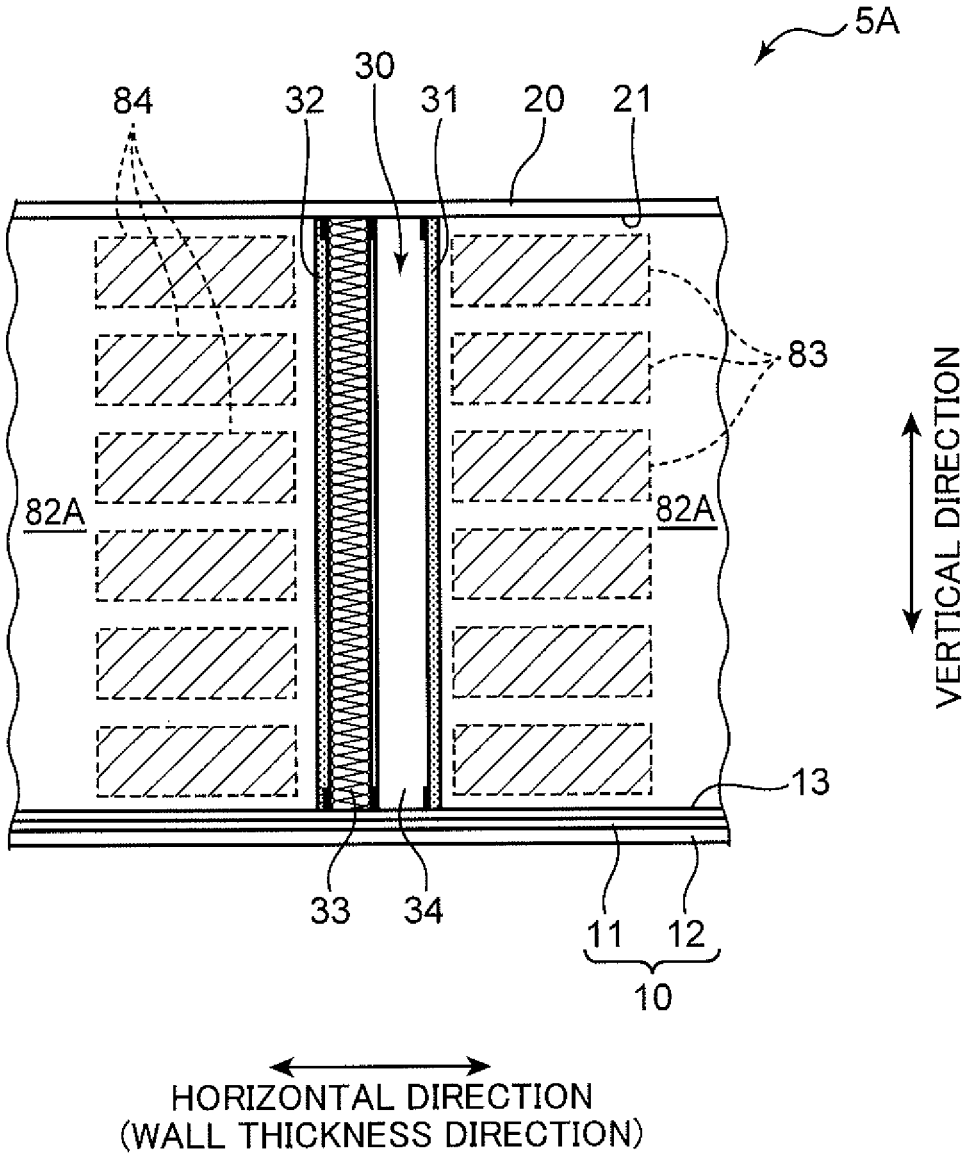
FIG. 9 is a vertical sectional view schematically illustrating a configuration of a partition wall sound insulation structure according to a modification of the fifth embodiment of the present invention.

FIG. 8 is a partial sectional view of the sound insulation structure 5 when the inner surface 82A of the outer wall face material 82 is viewed from the front. As illustrated in FIG. 8, the first outer wall side sound insulation face material 83 has a rectangular shape elongated in the vertical direction, and a plurality of the first outer wall side sound insulation face materials are disposed at intervals in the horizontal direction (the wall thickness direction of the partition wall 30). Similarly, the second outer wall side sound insulation face material 84 also has a rectangular shape elongated in the vertical direction, and the second outer wall side sound insulation face materials are disposed at intervals in the horizontal direction.

In the sound insulation structure 5 according to the fifth embodiment, the additional face material having the coincidence frequency different from that of the outer wall face material 82 is stuck to the portion of the outer wall face material 82 between the position corresponding to the outer surface of the partition wall 30 and the position corresponding to the center of the space S0 in the horizontal direction. Therefore, when sound generated in one of the first space S1 and the second space S2 is about to propagate to the other space via the outer wall 80 due to the coincidence effect, the coincidence effect of the outer wall face material 82 can be suppressed. Accordingly, sound leakage to an adjacent space via the outer wall 80 is suppressed to improve sound insulation performance.

End portions of the first outer wall side sound insulation face material 83 and the second outer wall side sound insulation face material 84 on the partition wall 30 side may further extend to a position overlapping the partition wall 30 in the wall surface direction. In addition, as in a partition wall sound insulation structure 5A according to a modification in FIG. 9, the first outer wall side sound insulation face material 83 and the second outer wall side sound insulation face material 84 may have a rectangular shape elongated in the horizontal direction (the wall thickness direction of the partition wall 30), and a plurality of the first and second outer wall side sound insulation face materials may be disposed at intervals in the vertical direction. Further, the present invention is not limited to the case where both the first outer wall side sound insulation face material 83 and the second outer wall side sound insulation face material 84 are provided, and only one of these may be provided.

Other Embodiments

Here, other embodiments of the present invention will be described.

Although the sound insulation face materials 40 in the first and second embodiments are formed to have substantially the same thickness from the first inner surface 31D to the second inner surface 32D, the sound insulation face material is not limited thereto, and for example, a recessed portion may be formed at a central portion in the width direction of the sound insulation face material 40. In addition, the sound insulation face material 40 is not exclusively stuck to the entire floor surface 13 or ceiling surface 21 in a range from the first inner surface 31D to the second inner surface 32D, but may be stuck only to a part of the floor surface 13 or the ceiling surface 21 in the range.

While the first embodiment has been described with respect to the case where the sound insulation face material 40 is made from an asphalt-based damping material, the present invention is not limited thereto, and the sound insulation face material may be made of, for example, a gypsum plasterboard having a surface density equal to or higher than a surface density of the ceiling material 20 or that of the face material (the first face material 31 and the second face material 32) of the partition wall 30. Further, a gypsum plasterboard having a coincidence frequency different from that of the ceiling material 20 or the floor material 10 by 1/12 octave may be used as the sound insulation face material 40.

Figure 10:
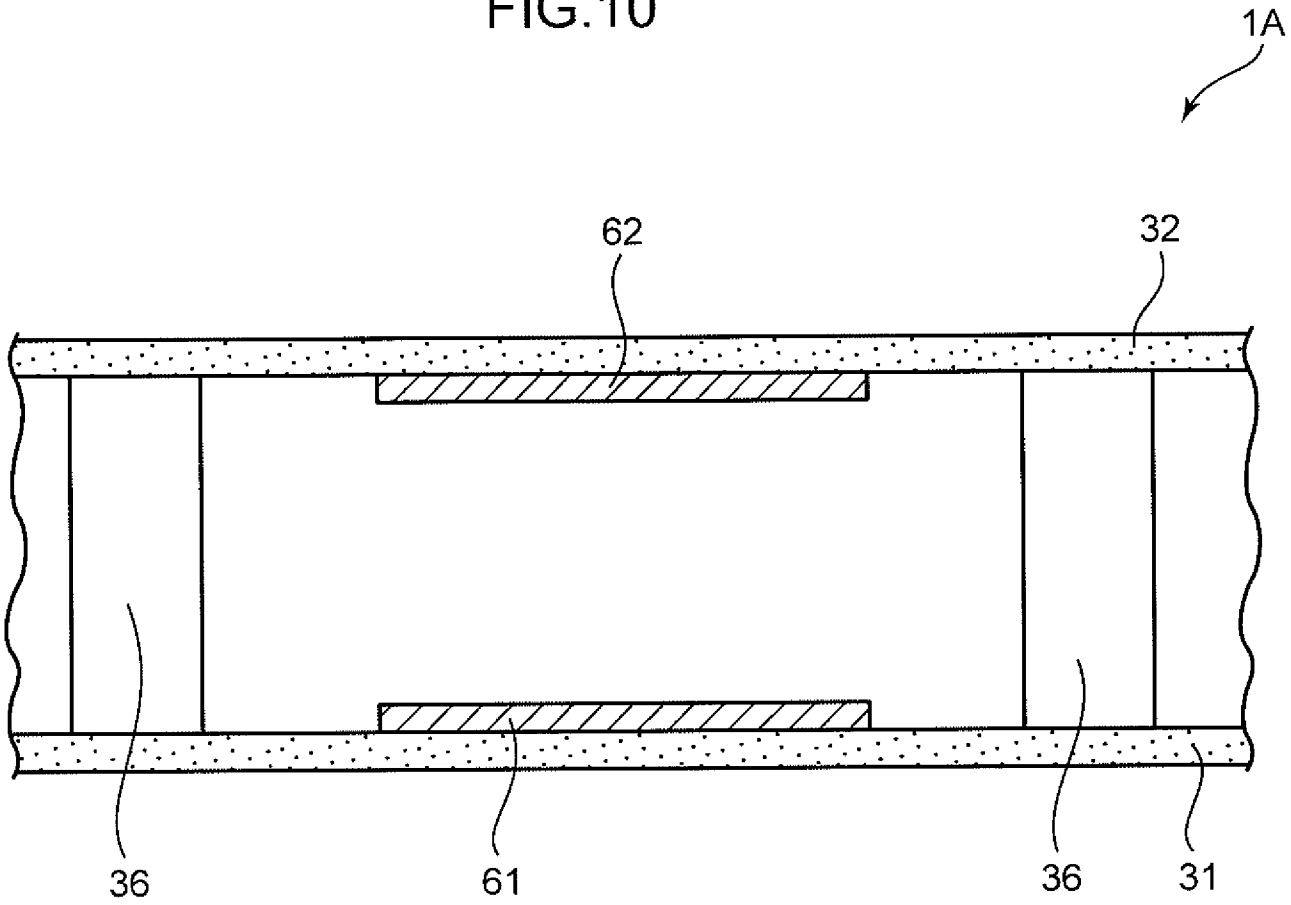
FIG. 10 is a horizontal sectional view schematically illustrating a configuration of a partition wall sound insulation structure according to the other embodiment of the present invention.

While the first embodiment has been described with respect to the case where the first studs 34 and the second studs 35 are arranged in a zigzag manner, the present invention is not limited thereto. For example, as in a partition wall sound insulation structure 1A according to a modification shown in FIG. 10, the first face material 31 and the second face material 32 may be fixed to both side surfaces of each stud 36. Although in FIG. 10, the first wall-side sound insulation face material 61 and the second wall-side sound insulation face material 62 are disposed between adjacent studs 36, one or both of them may be omitted.

In the fourth embodiment, a plurality of either one or both of the first ceiling-side sound insulation face materials 71 and the second ceiling-side sound insulation face materials 72 may be overlapped. In this case, in order to prevent the coincidence frequency of the face material from fluctuating, it is preferable to laminate the face materials without bonding to each other.

In the fourth embodiment, one or both of the first ceiling-side sound insulation face material 71 and the second ceiling-side sound insulation face material 72 may be stuck to the ceiling upper surface 22 in the entire space between the adjacent cradlings 70, and a method of bonding to the ceiling upper surface 22 is not particularly limited and any method enabling sticking to the ceiling upper surface 22 is applicable in addition to the adhesive. In addition, one or both of the first ceiling-side sound insulation face material 71 and the second ceiling-side sound insulation face material 72 may be stuck to the ceiling upper surface 22 not only in one space between cradlings but also in another space between cradlings.

In the fourth embodiment, one or both of the first ceiling-side sound insulation face material 71 and the second ceiling-side sound insulation face material 72 may be stuck to the ceiling surface 21.

In the fourth embodiment, the cradling 70 may be disposed such that the length direction faces the wall thickness direction of the partition wall 30. In this case, the first ceiling-side sound insulation face material 71 and the second ceiling-side sound insulation face material 72 may also be stuck to a portion of the ceiling upper surface 22 overlapping the hollow portion S3 of the partition wall 30 in the vertical direction. However, in order to secure a wiring space in the ceiling space, no face material may be disposed at the portion.

In the fourth embodiment, it is not particularly limited whether or not the end portions of the first ceiling-side sound insulation face material 71 and the second ceiling-side sound insulation face material 72 are in contact with the one cradling 70 and the cradling 70 adjacent to the one cradling 70.

The above embodiments are summarized as follows.

The partition wall sound insulation structure according to the above embodiment includes: a floor material on which a floor surface is formed; a ceiling material on which a ceiling surface is formed, the ceiling surface being opposed to the floor surface in a vertical direction with a space in a building interposed therebetween; a partition wall that partitions the space in a horizontal direction and includes a pair of face materials that extends in the vertical direction and is disposed with a hollow portion interposed therebetween in the horizontal direction, and a stud that is disposed in the hollow portion and supports the pair of face materials; a positioning member for positioning the stud in the horizontal direction; and a sound insulation face material disposed on at least one of the floor surface and the ceiling surface in the hollow portion. The pair of face materials is disposed with a gap formed in the vertical direction between the at least one surface and the pair of face materials. The sound insulation face material is thicker than the gap, is disposed so as to block the gap from a hollow portion side, and includes a portion having a surface density higher than that of the positioning member.

In the partition wall sound insulation structure, the sound insulation face material thicker than the gap between at least one of the floor surface and the ceiling surface and the face material of the partition wall is disposed in the hollow portion of the partition wall, and the gap is blocked by the sound insulation face material from the hollow portion side of the partition wall. Therefore, sound leakage between chambers through the gap can be suppressed. In addition, the sound insulation face material includes the portion having the surface density higher than that of the positioning member that positions the stud of the partition wall. Therefore, as compared with a case where the gap is blocked by the positioning member directly disposed on the floor surface or the ceiling surface, sound leakage between chambers through the gap can be effectively suppressed. Accordingly, the partition wall sound insulation structure enables further improvement of sound insulation performance.

In the partition wall sound insulation structure, the sound insulation face material may include a first face material portion having a same thickness as the gap and a second face material portion overlapping the pair of face materials in a wall thickness direction of the partition wall. The second face material portion may have a surface density higher than a surface density of the positioning member.

According to this configuration, sound which is about to propagate through the gap to the hollow portion side of the partition wall by the shortest distance can be more reliably blocked by the sound insulation face material.

In the partition wall sound insulation structure, the surface density of the second face material portion may be equal to or higher than a surface density of the pair of face materials.

According to this configuration, it is possible to ensure sound insulation performance equal to or higher than that of a central portion or the like of the face material on the gap side, and it is possible to realize sound insulation performance equal to or higher than a certain level in the partition wall as a whole.

In the partition wall sound insulation structure, the sound insulation face material may be disposed on the floor surface and have a coincidence frequency different from that of the floor material.

According to this configuration, when sound generated in one of the spaces partitioned by the partition wall is about to propagate to the other via the floor material due to the coincidence effect, the coincidence effect of the floor material can be suppressed. As a result, sound leakage to an adjacent space due to the coincidence effect via the floor material is suppressed.

In the partition wall sound insulation structure, the sound insulation face material may be disposed on the ceiling surface and have a coincidence frequency different from that of the ceiling material.

According to this configuration, when sound generated in one of the spaces partitioned by the partition wall is about to propagate to the other via the ceiling material due to the coincidence effect, the coincidence effect of the ceiling material can be suppressed. As a result, sound leakage to an adjacent space due to the coincidence effect via the ceiling material is suppressed.

In the partition wall sound insulation structure, the pair of face materials may include a first face material, and a second face material disposed with a hollow portion interposed between the first face material and the second face material. The first face material may have a first inner surface facing a hollow portion side. The second face material may have a second inner surface facing the hollow portion side and opposed to the first inner surface with the hollow portion interposed therebetween. The partition wall may include a first stud extending in the vertical direction and fixed to the first inner surface, and a second stud extending in the vertical direction and fixed to the second inner surface. The first studs and the second studs may be arranged in a zigzag manner along a wall surface direction of the partition wall. The partition wall sound insulation structure may further include: at least one face material out of a first wall-side sound insulation face material stuck to a part of the first inner surface so as to overlap the second stud in a front view of the first face material and having a coincidence frequency different from that of the first face material, and a second wall-side sound insulation face material stuck to a part of the second inner surface so as to overlap the first stud in a front view of the second face material and having a coincidence frequency different from that of the second face material.

According to this configuration, by additionally disposing the face material having the coincidence frequency different from that of the face material of the partition wall, sound leakage to an adjacent space via the partition wall can be more effectively suppressed. In addition, since the additional face material is provided on the hollow portion side of the partition wall, it is also possible to suppress an increase in the thickness of the partition wall.

In the partition wall sound insulation structure, the partition wall may partition the space into a first space and a second space adjacent to each other in the horizontal direction. The pair of face materials may include a first face material, and a second face material disposed with a hollow portion interposed between the first face material and the second face material. The first face material may have a first outer surface facing a first space side. The second face material may have a second outer surface facing a second space side. The partition wall sound insulation structure may further include: at least one face material out of a first ceiling-side sound insulation face material having a coincidence frequency different from that of the ceiling material and stuck to at least a portion of the ceiling material between a position corresponding to the first outer surface and a position corresponding to a center of the first space in the horizontal direction, and a second ceiling-side sound insulation face material having a coincidence frequency different from that of the ceiling material and stuck to at least a portion of the ceiling material between a position corresponding to the second outer surface and a position corresponding to a center of the second space in the horizontal direction.

According to this configuration, when sound generated in one of the first space and the second space partitioned by the partition wall is about to propagate to the other space via the ceiling material due to the coincidence effect, the coincidence effect of the ceiling material can be suppressed outside the partition wall. Accordingly, sound leakage to an adjacent space via the ceiling material due to the coincidence effect is suppressed to further improve sound insulation performance.

In the partition wall sound insulation structure, the partition wall may partition the space into a first space and a second space adjacent to each other in the horizontal direction. The pair of face materials may include a first face material, and a second face material disposed with a hollow portion interposed between the first face material and the second face material. The first face material may have a first outer surface facing a first space side. The second face material may have a second outer surface facing a second space side. The partition wall sound insulation structure may further include: an outer wall extending in a direction intersecting the partition wall; and at least one face material out of a first outer wall side sound insulation face material having a coincidence frequency different from that of the outer wall and stuck to at least a portion of the outer wall between a position corresponding to the first outer surface and a position corresponding to a center of the first space in the horizontal direction, and a second outer wall side sound insulation face material having a coincidence frequency different from that of the outer wall and stuck to at least a portion of the outer wall between a position corresponding to the second outer surface and a position corresponding to a center of the second space in the horizontal direction.

According to this configuration, when sound generated in one of the first space and the second space partitioned by the partition wall is about to propagate to the other space via the outer wall due to the coincidence effect, the coincidence effect of the outer wall can be suppressed outside the partition wall. Accordingly, sound leakage to an adjacent space via the outer wall due to the coincidence effect is suppressed to further improve sound insulation performance.

The sound insulation member for a partition wall according to the above embodiment is a member for use in the above partition wall sound insulation structure, and includes the sound insulation face material; and the positioning member disposed on the sound insulation face material.

It should be understood that the embodiments disclosed herein are illustrative in all respects and are not restrictive. The scope of the present invention is indicated not by the above description but by the claims, and it is intended that meanings equivalent to the claims and all modifications within the scope are included.

The invention claimed is:

1. A partition wall sound insulation structure comprising:

a floor material on which a floor surface is formed;

a ceiling material on which a ceiling surface is formed, the ceiling surface being opposed to the floor surface in a vertical direction with a space in a building interposed therebetween;

a partition wall that partitions the space in a horizontal direction and includes:

a pair of face materials including a first face material and a second face material that extend in the vertical direction and are disposed with a hollow portion interposed therebetween in the horizontal direction, the first face material having a first inner surface facing the hollow portion, the second face material having a second inner surface that faces the hollow portion and is opposed to the first inner surface, a first stud that is disposed in the hollow portion, that supports the pair of face materials, that extends in the vertical direction, and that is fixed to the first inner surface, and a second stud that is disposed in the hollow portion, that extends in the vertical direction, and that is fixed to the second inner surface;

a positioning member for positioning the first stud and the second stud in the horizontal direction; and a sound insulation face material disposed on at least one of the floor surface and the ceiling surface in the hollow portion, wherein the pair of face materials is disposed with a gap formed in the vertical direction between the at least one surface and the pair of face materials, the sound insulation face material is thicker than the gap, is disposed so as to block the gap from the hollow portion side, and includes a first surface facing the hollow portion and having a surface density higher than that of the positioning member, the positioning member is disposed in the hollow portion so as to sandwich the sound insulation face material between the at least one of the floor surface and the ceiling surface and the positioning member, the positioning member including a first positioning portion provided between the first stud and the first inner surface, a second positioning portion provided between the second stud and the second inner surface, at least one central positioning portion provided between the first positioning portion and the second positioning portion, and at least one base portion connecting the first positioning portion and the second positioning portion to the at least one central positioning portion to form two grooves into which end portions of the first stud and the second stud are respectively inserted, and the at least one central positioning portion extends in the vertical direction from the at least one base portion to a position which allows the at least one central positioning portion to position the first stud and the second stud in the horizontal direction, and extends in a wall surface direction of the partition wall.

2. The partition wall sound insulation structure according to claim 1, wherein the sound insulation face material includes a first face material portion having a same thickness as the gap and a second face material portion overlapping the pair of face materials in a wall thickness direction of the partition wall, the second face material portion including the first surface having the surface density higher than the surface density of the positioning member.

3. The partition wall sound insulation structure according to claim 2, wherein the surface density of the first surface of the second face material portion is equal to or higher than a surface density of the pair of face materials.

4. The partition wall sound insulation structure according to claim 1, wherein the sound insulation face material is disposed on the floor surface and has a coincidence frequency different from that of the floor material.

5. The partition wall sound insulation structure according to claim 1, wherein the sound insulation face material is disposed on the ceiling surface and has a coincidence frequency different from that of the ceiling material.

6. The partition wall sound insulation structure according to claim 1, wherein the first stud and the second stud are arranged in a zigzag manner along the wall surface direction of the partition wall, the partition wall sound insulation structure further comprising:

at least one face material out of a first wall-side sound insulation face material stuck to a part of the first inner surface so as to overlap the second stud in a front view of the first face material and having a coincidence frequency different from that of the first face material, and a second wall-side sound insulation face material stuck to a part of the second inner surface so as to overlap the first stud in a front view of the second face material and having a coincidence frequency different from that of the second face material.

7. The partition wall sound insulation structure according to claim 1, wherein the partition wall partitions the space into a first space and a second space adjacent to each other in the horizontal direction, and the first face material has a first outer surface facing a first space side, and the second face material has a second outer surface facing a second space side, the partition wall sound insulation structure further comprising:

at least one face material out of a first ceiling-side sound insulation face material having a coincidence frequency different from that of the ceiling material and stuck to at least a portion of the ceiling material between a position corresponding to the first outer surface and a position corresponding to a center of the first space in the horizontal direction, and a second ceiling-side sound insulation face material having a coincidence frequency different from that of the ceiling material and stuck to at least a portion of the ceiling material between a position corresponding to the second outer surface and a position corresponding to a center of the second space in the horizontal direction.

8. The partition wall sound insulation structure according to claim 1, wherein the partition wall partitions the space into a first space and a second space adjacent to each other in the horizontal direction, the first face material has a first outer surface facing a first space side, and the second face material has a second outer surface facing a second space side, the partition wall sound insulation structure further comprising:

an outer wall extending in a direction intersecting the partition wall; and at least one face material out of a first outer wall side sound insulation face material having a coincidence frequency different from that of the outer wall and stuck to at least a portion of the outer wall between a position corresponding to the first outer surface and a position corresponding to a center of the first space in the horizontal direction, and a second outer wall side sound insulation face material having a coincidence frequency different from that of the outer wall and stuck to at least a portion of the outer wall between a position corresponding to the second outer surface and a position corresponding to a center of the second space in the horizontal direction.

9. The partition wall sound insulation structure according to claim 1, wherein a length of the first positioning portion in the vertical direction, a length of the second positioning portion in the vertical direction, and a length of the at least one central positioning portion in the vertical direction are substantially same as one another.

10. A sound insulation member for use in a structure, the structure comprising:

a floor material on which a floor surface is formed;

a ceiling material on which a ceiling surface is formed, the ceiling surface being opposed to the floor surface in a vertical direction with a space in a building interposed therebetween, and a partition wall that partitions the space in a horizontal direction and includes:

a pair of face materials including a first face material and a second face material that extend in the vertical direction and are disposed with a hollow portion interposed therebetween in the horizontal direction, the first face material having a first inner surface facing the hollow portion, the second face material having a second inner surface that faces the hollow portion and is opposed to the first inner surface, a first stud that is disposed in the hollow portion, that supports the pair of face materials, that extends in the vertical direction, and that is fixed to the first inner surface, and a second stud that is disposed in the hollow portion, that extends in the vertical direction, and that is fixed to the second inner surface;

the sound insulation member comprising:

a positioning member for positioning the first stud and the second stud in the horizontal direction; and a sound insulation face material disposed on at least one of the floor surface and the ceiling surface in the hollow portion, wherein the pair of face materials is disposed with a gap formed in the vertical direction between the at least one surface and the pair of face materials, the sound insulation face material is thicker than the gap, is disposed so as to block the gap from the hollow portion side, and includes a first surface facing the hollow portion and having a surface density higher than that of the positioning member, and the positioning member is disposed in the hollow portion so as to sandwich the sound insulation face material between the at least one of the floor surface and the ceiling surface and the positioning member, the positioning member including a first positioning portion provided between the first stud and the first inner surface, a second positioning portion provided between the second stud and the second inner surface, at least one central positioning portion provided between the first positioning portion and the second positioning portion, and at least one base portion connecting the first positioning portion and the second positioning portion to the at least one central positioning portion to form two grooves into which end portions of the first stud and the second stud are respectively inserted, the at least one central positioning portion extends in the vertical direction from the at least one base portion to a position which allows the at least one central positioning portion to position the first stud and the second stud in the horizontal direction, and extends in a wall surface direction of the partition wall.

11. The sound insulation member according to claim 10, wherein a length of the first positioning portion in the vertical direction, a length of the second positioning portion in the vertical direction, and a length of the at least one central positioning portion in the vertical direction are substantially same as one another.

* * * * *